US006006528A

United States Patent [19]

Arima et al.

[11] Patent Number: 6,006,528

[45] Date of Patent: Dec. 28, 1999

[54] AIR CONDITIONING SYSTEM

[75] Inventors: Hidetoshi Arima; Nobuhiro Idei; Hisao Honda; Kazuhiro Shimura; Naohito Sakamoto; Toshio Kubo; Mamoru Kubo; Hiroyuki Takada, all of Gunma-ken, Japan

[73] Assignee: Sanyo Electric Co., Ltd., Osaka-fu, Japan

[21] Appl. No.: 08/961,303

[22] Filed: Oct. 30, 1997

[30] Foreign Application Priority Data

| | | | |
|---|---|---|---|
| Oct. 31, 1996 | [JP] | Japan | 8-290156 |
| Oct. 31, 1996 | [JP] | Japan | 8-290157 |
| Oct. 31, 1996 | [JP] | Japan | 8-290160 |
| Nov. 21, 1996 | [JP] | Japan | 8-310929 |
| Jun. 9, 1997 | [JP] | Japan | 9-151206 |
| Jun. 12, 1997 | [JP] | Japan | 9-155231 |
| Jun. 12, 1997 | [JP] | Japan | 9-155236 |

[51] Int. Cl.[6] ..... F25D 17/02

[52] U.S. Cl. ..... 62/185; 62/209; 236/1 B; 165/104.25

[58] Field of Search ..... 236/1 B; 62/207, 62/208, 209, 185; 165/104.21, 104.22, 104.25

[56] References Cited

U.S. PATENT DOCUMENTS

| | | | |
|---|---|---|---|
| 4,664,177 | 5/1987 | Edelstein | 165/1 |
| 4,843,832 | 7/1989 | Yamada et al. | 62/159 |
| 5,050,396 | 9/1991 | Ohkoshi et al. | 62/106 |

FOREIGN PATENT DOCUMENTS 7151359 6/1995 Japan .

OTHER PUBLICATIONS

Toshiba (UK Published Patent Application 2,249,168A), Apr. 29, 1992.

Japanes Patent Unexamined Publication 7–151359, Jun. 13, 1995.

*Primary Examiner*—Henry Bennett

*Assistant Examiner*—Marc Norman

*Attorney, Agent, or Firm*—Weingarten, Schurgin, Gagnebin & Hayes LLP

[57] ABSTRACT

In an air conditioning system for circulating a fluid which can change a phase between a gas phase and a liquid phase by a difference of a specific gravity between the gas phase and the liquid phase between an heat source side machine and a plurality of user side machines more than half of which are disposed below the heat source side machine, so that each of the user side machines performs a cooling operation, each of the user side machines is provided with a heat exchanger, a flow control valve for controlling a volume of said fluid supplied to the heat exchanger, a blow means for supplying an air-conditioned air to a room through the heat exchanger, a physical value detecting means for detecting a physical value relating to an air conditioning load such as a temperature and a signal controlling means for the operating and detecting portions, and wherein the heat source side machine is provided with a control means for communicating with said signal controlling means and outputting a control signal to said flow control valve of the user side machine. Accordingly, even in the case that the cooling load is the same, the opening ratio of the flow control valve of the user side machine mounted on the higher floor can be controlled so as to be greater than that of the user side machine mounted on the lower floor. In accordance with the above structure, the air conditioning characteristic in the air conditioning system which is basically controlled by a natural circulation and in which it is hard to supply the fluid to the user side machine mounted on the higher floor, so that it is hard to operate the air conditioning can be improved.

12 Claims, 8 Drawing Sheets

AIR CONDITIONING SYSTEM

BACKGROUND OF THE INVENTION

1. Field of the Intention

The present invention relates to an air conditioning system, and more particularly to a system for circulating a fluid which can change a phase between a gas phase and a liquid phase by a difference of a specific gravity between a gas and a liquid between a heat source side machine and a plurality of user side machines disposed below the heat source side machine, so that each of the user side machines can at least perform a cooling.

2. Background Art

Conventional arts include, for example, a system as shown in FIG. 8 as an air conditioning system which does not need a power for transporting a phase-changeable fluid, that is, a fluid changing a phase between a liquid phase and a gas phase by outputting or inputting a latent heat. In this system, a heat source side machine 1 serving as a condenser is mounted at a high position of a building, and a liquid phase pipe 6 and a gas phase pipe 7 connect the heat source side machine with a heat exchanger 5 of a user side machine 4 mounted in a room to be air-conditioned disposed in a lower position than the heat source side machine. The system supplies a liquid which is heat-discharged and condensed in the heat source side machine 1 to the heat exchanger 5 of the user side machine 4 through the liquid phase pipe 6 by its own weight and on the contrary returns a gas which is heat-absorbed and evaporated by heat-exchanging with a warm air of the room in the user side machine 4 to the heat source side machine 1 through the gas phase pipe 7, thereby capable of performing a circulation. Accordingly, there are advantages such that a transporting power such as an electric pump is not necessary and a running cost at a time of performing a cooling can be reduced. In this case, reference numeral 8 denotes a flow control valve and reference numeral 9 denotes a blower.

Further, an air conditioning system as shown in FIG. 9 is disclosed in Japanese Patent Unexamined Publication No. 7-151359. In the air conditioning system having the above structure, the heat source side machine 1 disposed at a high position can supply a condensed refrigerant or an evaporated refrigerant, and reference numeral 30 denotes an electric pump and reference numerals 31 to 34 denote an opening and closing valve. These elements are connected by the liquid phase pipe 6 and the gas phase pipe 7 as shown in the drawing so as to form a closed circuit 3. The phase-changeable fluid sealed within the closed circuit 3 circulates between the heat source side machine 1 and the user side machine 4 so that the user side machine 4 can perform a cooling or a heating. In this case, reference numeral 35 denotes a liquid level sensor disposed in a side surface of the heat source side machine 1, which controls the electric pump 30 in such a manner as to make a refrigerant fluid stored in the heat source side machine 1 at a time of heating constant.

Accordingly, in the air conditioning system capable of performing a cooling operation and a heating operation as shown in FIG. 9, when the temperature of the room in which the user side machine 4 is mounted is high, in a state of stopping the electric pump 30, the opening and closing valves 31 and 32 are closed and the opening and closing valves 33 and 34 are opened, and further, the flow controlling valve 8 is also opened. Therefore, when the refrigerant sealed within the closed circuit 3 is condensed and cooled in the heat source side machine 1, the refrigerant fluid condensed in the heat source side machine 1 drops in the liquid phase pipe 6 by its own weight and flows into the heat exchanger 5 through the opening and closing valves 33 and 34 and the flow control valve 8.

Then, the refrigerant fluid flowing into the heat exchanger 5 absorbs the heat from the air within the room through the pipe wall of the heat exchanger so as to perform a cooling operation, and the refrigerant itself evaporates and flows into the gas phase pipe 7, thereby recirculating to the heat source side machine 1 of which pressure becomes lower by condensation of the refrigerant so as to form a natural circulation Accordingly, since the electric power for driving the electric pump 30 is not necessary in the summer time when the electric power consumption becomes maximum during a year, there is an advantage that the running cost can be reduced.

Further, in a state that the opening and closing valves 31 and 34 are closed and the opening and closing valves 32 and 33 are opened, and further, the flow control valve 8 is also opened, when the electric pump 30 is driven and the refrigerant sealed within the closed circuit 3 is condensed and cooled in the heat source side machine 1, the refrigerant fluid condensed in the heat source side machine 1 drops in the liquid phase pipe 6 by its own weight and the discharging force of the electric pump 30, and flows into the heat exchanger 5 through the flow control valve 8, thereby forcibly circulating the refrigerant for performing the cooling operation.

As mentioned above, in the case that the cooling operation is performed by driving the electric pump 30, there is an advantage that a sufficient amount of refrigerant fluid can be supplied to the heat exchanger 5 mounted in the higher floor which corresponds to the place immediately below the heat source side machine 1.

On the contrary, in the case that the temperature of the room in which the user side machine 4 is mounted is low, when the opening and closing valves 32 and 33 are closed and the opening and closing valves 31 and 34 are opened, and further, the flow controlling valve 8 is also opened, and in a state that the electric pump is driven, when the refrigerant sealed within the closed circuit 3 is heated and evaporated by the heat source side machine 1, the refrigerant gas evaporated in the heat source side machine 1 flows into the heat exchanger 5 through the gas phase pipe 7.

Then, the refrigerant gas flowing into the heat exchanger 5 discharges the heat to the air within the room through the pipe wall of the heat exchanger so as to perform a heating operation, and the refrigerant itself condenses and flows into the liquid phase pipe 6, thereby recirculating to the heat source side machine 1 through the opening and closing valves 34 and 31 by the electric pump 30. Accordingly, the heating by the user side machine 4 can be continued.

However, in the air conditioning system as shown in FIG. 8, since all the weight of the fluid which discharges the heat in the heat source side machine, is condensed and is stored in the liquid phase pipe acts as a pressure to the heat exchanger of the user side machine mounted on the lower floor, the fluid can be easily supplied, but to the heat exchanger of the user side machine mounted on the higher floor, since only the weight of the fluid stored in the liquid phase pipe disposed above the part acts as a pressure, the more difficult it is to supply the fluid, the higher floor the user side machine is mounted on, so that the cooling performance tends to be insufficient.

In order to solve this problem, it is possible to make the volume of the flow control valve of the user side machine mounted on the higher floor larger than the volume of the flow control valve of the user side machine mounted on the lower floor, so that the fluid is easily supplied to the flow control valve of the user side machine mounted on the higher floor. However, in this structure, it is necessary to prepare the user side machines having various kinds of volumes, so that the control in the work area becomes complex and the cost is increased. Accordingly, in the air conditioning system for basically performing a natural circulation of the phase-changeable fluid even in the case of using the user side machine having the same volume, it is necessary to provide a system capable of performing an optimum flow circulation.

Further, in this kind of air conditioning system, since the liquid discharged heat and condensed in the heat source side machine is supplied to the heat exchanger of the user side machine by its own weight, when the sudden heat load is generated at a time of starting the cooling, the fluid is evaporated in the heat exchanger of the user side machine at a short time and the pressure within the gas phase pipe is increased so that it is hard that the fluid flows into the heat exchanger, and further, the fluid flows backward in the flow control valve 8 so that the heat absorbing and evaporating phenomenon in the heat exchanger is stopped, thereby incapable of performing the cooling operation.

Further, in the air conditioning system as shown in FIG. 9, since the refrigerant gas heated and generated in the heat source side machine is supplied to the heat exchanger of the user side machine by the heated gas pressure, when the sudden heat load is generated at a starting time of the heating, the supply of the refrigerant gas is not good enough, so that so-called a sleep phenomenon of the refrigerant, that is, the condensed refrigerant is stored in the heat exchanger of the user side machine occurs, thereby blowing the unheated wind within the room. Since the amount of the refrigerant sealed within the closed circuit is constant, it is considered that the electric pump is stopped or the refrigerant from the user side machine is not returned to the heat source side machine- Accordingly, there is a problem that the pressure in the closed circuit locally increases more than necessity.

Still further, when the temperature of the open air is low, a lot of phase-changeable fluid is condensed within the pipe so that a so-called sleeping phenomenon occurs Accordingly, it is necessary to excessively charge within the pipe taking the sleeping phenomenon into consideration There is a problem that if the excess charge is not prepared, the circulating amount is insufficient so that a sufficient heating performance can not be obtained.

Furthermore, in the case of performing the cooling operation by naturally circulating the refrigerant in a state of stopping the electric pump, the electric power consumption in the summer in which the electric power is consumed at a maximum rate can be reduced so that reduction of the running cost can be realized. However, it is hard to supply a sufficient amount of refrigerant to the user side machine mounted on the higher floor which has a small difference in level from the place in which the heat source side machine is mounted In addition to this, even in the user side machine mounted on the same floor, in accordance with the difference in view of the pipe length and the arranging angle, there are a case that the refrigerant is easily supplied and a case that the refrigerant is hardly supplied, so that there is a problem that it is difficult to securely control the room temperature.

On the contrary, when the electric pump is driven, the sufficient amount of refrigerant can be supplied to the user side machine mounted on the higher floor so that the necessary cooling can be secured However, in this case, the electric power for driving the pump is necessary. Further, since the electric pump necessary in this case is a large size pump having a capacity of transporting the refrigerant fluid condensed in the user side machine at a time of heating to the heat source side machine mounted above, there is a problem that the electric power consumption is further necessary. Accordingly, there is a need for solving these problems.

SUMMARY OF THE INVENTION

An object of the present invention is to provide an air conditioning system for solving the above problems.

In accordance with the present invention, there is provided an air conditioning system for circulating a fluid which can change a phase between a gas phase and a liquid phase by a difference of a specific gravity between the gas phase and the liquid phase between a heat source side machine and a plurality of user side machines more than half of which are disposed below the heat source side machine, so that each of the user side machines performs a cooling operation, in which each of the user side machines has a heat exchangers a flow control valve for controlling a volume of the fluid supplied to the heat exchanger, a blow means for supplying an air-conditioned air to a room through the heat exchanger, a physical value detecting means for detecting a physical value relating to an air-conditioned load such as a temperature and a signal controlling means connected to the heat exchanger, the flow control valve, the blow means and the physical value detecting means, and wherein the heat source side machine has a control means for communicating with the signal controlling means and outputting a control signal to the flow control valve of the user side machine.

In accordance with the invention as recited in claim 2, there is provided an air conditioning system in which the control means has a function of determining the set opening ratio with considering a signal output from the physical value detecting means and a height, in which the user side machine is mounted, relative to a height in which the heat source side machine is mounted In accordance with the invention as recited in claim 3, there is provided an air conditioning system in which said control means has a function of determining the set opening ratio of the flow control valve greater in accordance that the user side machine is mounted on an higher floor.

In accordance with the invention as recited in claim 4, there is provided an air conditioning system in which the control means has a function of holding the opening ratio of said flow control valve at a predetermined small opening ratio for a predetermined period when a cooling has been started.

In accordance with the invention as recited in claim 5, there is provided an air conditioning system in which the control means has a function of holding the opening ratio of the flow control valve at a smaller opening ratio in accordance that the user side machine is mounted on the higher floor for a predetermined period when the cooling has been started.

In accordance with the invention as recited in claim 6, there is provided an air conditioning system in which a flow passage switching mechanism and a pump are provided in a liquid phase pipe in which a liquid phase fluid flows, the fluid absorbed heat in the heat source side machine and evaporated is introduced into the user side machine so as to be discharged heat and condensed, the condensed fluid is returned to the heat source side machine by the discharging force of said pump so that a heating is performed in each of the user side machines, and said control means has a function of holding the opening ratio of the flow control valve at a predetermined large opening ratio for a predetermined period when a heating has been started.

In accordance with the invention as recited in claim 7, there is provided an air conditioning system in which the control means has a function of holding the opening ratio of the flow control valve at a larger opening ratio in accordance that the user side machine is mounted on the lower floor for a predetermined period when the heating has been started.

In accordance with the invention as recited in claim 8, there is provided an air conditioning system in which a flow passage switching mechanism and a pump are provided in a liquid phase pipe in which a liquid phase fluid flows, the fluid absorbed heat in the heat source side machine and evaporated is introduced into the user side machine so as to be discharged heat and condensed, the condensed fluid is returned to the heat source side machine by the discharging force of said pump so that a heating is performed in each of the user side machines, and said control means has a function of almost fully opening the opening ratio of the flow control valve at a time of detecting an insufficiency in the circulating amount of the fluid during a heating.

In accordance with the invention as recited in claim 9, there is provided an air conditioning system in which a liquid phase pipe in which the liquid phase fluid flows and a gas phase pipe in which the gas phase fluid flows are respectively divided from main pipes connected to the heat source side machine, end portions of the divided pipes connected to the respective user exchangers are connected to each other via an opening and closing valve, and the control means has a function of opening the opening and closing valve in response to the fully opening operation of the flow control valve in an interlocking manner.

In accordance with the invention as recited in claim 10, there is provided an air conditioning system in which the control means has a function of once opening said opening and closing valve at a time of starting a heating.

In accordance with the invention as recited in claim 11, there is provided an air conditioning system in which when the physical value detecting means recognizes a state that an inlet or outlet temperature of the fluid flowing in the effectively operating user side machines or a difference of the physical value effected by the temperature difference is significant in comparison with that of the plurality of the other effectively operating user side machines continues for a predetermined period of time, the control means has a function of adjusting said flow control valve of the plurality of the other user side machines in a direction of resolving the significant state of the user side machine in the significant state.

In accordance with the invention as recited in claim 12, there is provided an air conditioning system in which when the physical value detecting means recognizes a state that an inlet or outlet temperature of the fluid flowing in the effectively operating user side machines or a difference of the physical value effected by the temperature difference is significant in comparison with that of the plurality of the other effectively operating user side machines continues for a predetermined time period, the control means has a function of adjusting the flow control valve of the user side machines in a direction of resolving said significant state.

DESCRIPTION OF THE PREFERRED EMBODIMENTS

Figure 8:
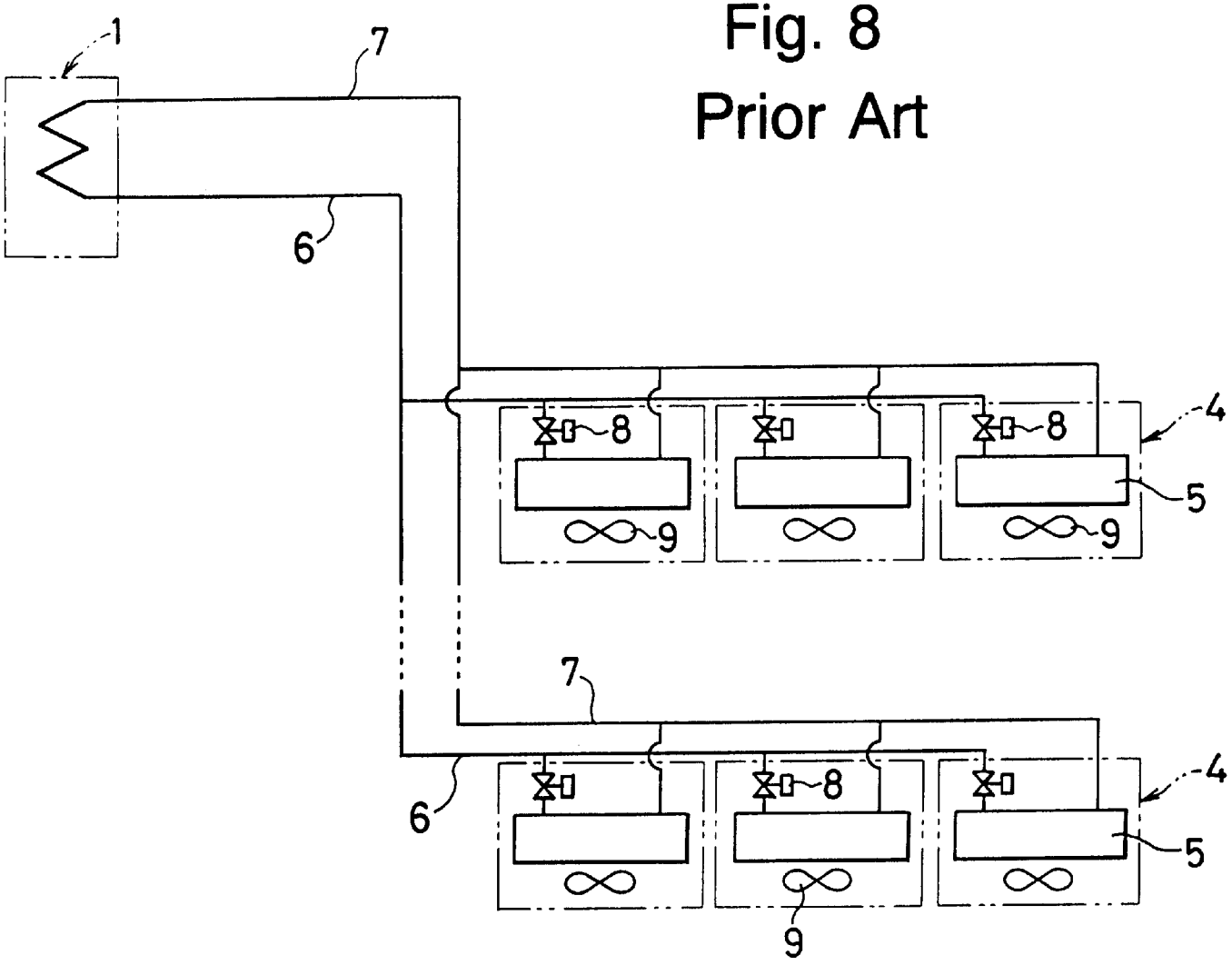
Fig. 8 Prior Art
FIG. 8 is a view which explains a prior art.
Figure 9:
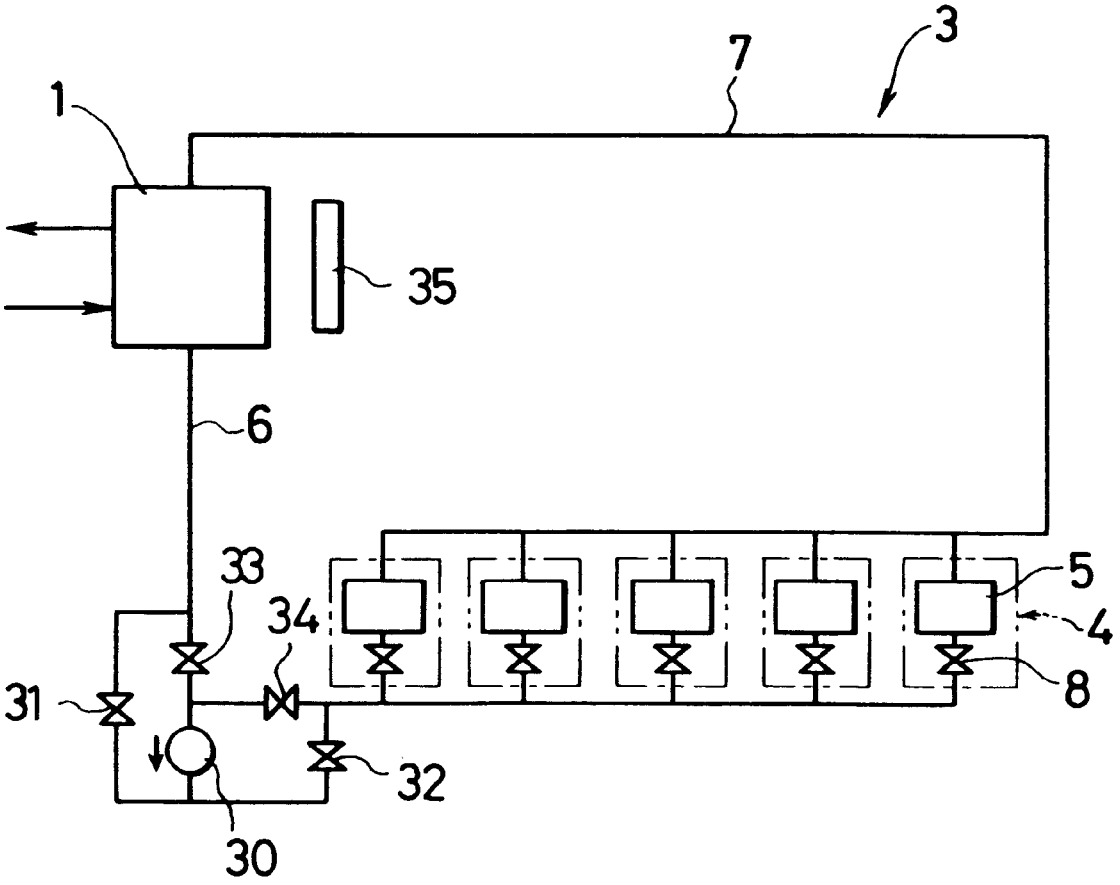
Fig. 9 Prior Art
FIG. 9 is a view which explains another prior art.

An embodiment in accordance with the present invention will be described below with reference to FIGS. 1 to 7. In this case, in order to easily understand the structure, the same reference numerals are attached to the parts having the same functions of the parts explained in FIGS. 8 and 9.

Figure 1:
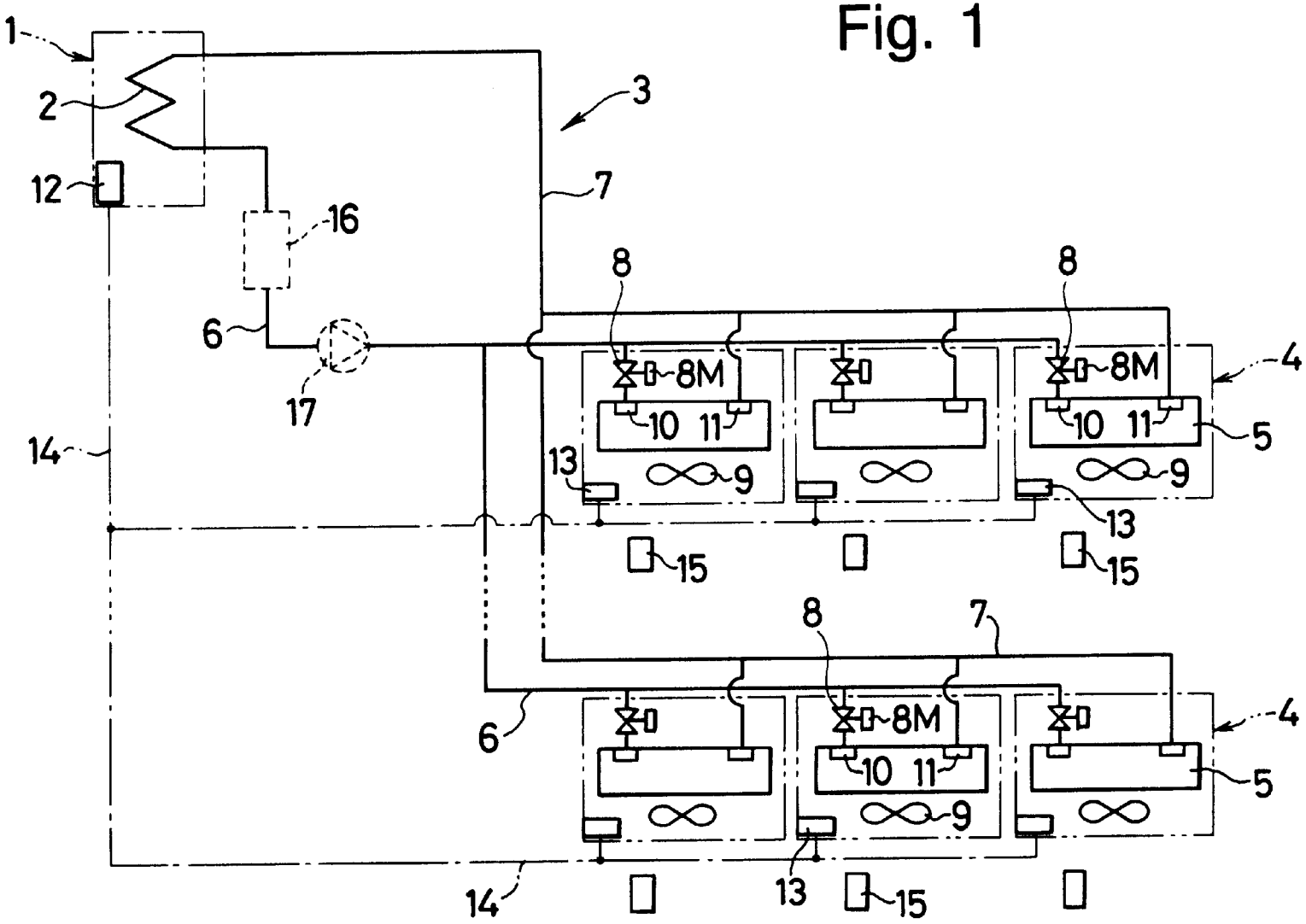
FIG. 1 is a view which explains on air conditioning system constituted for only performing a cooling.

FIG. 1 shows an embodiment of an air conditioning system in accordance with the present invention, in which reference numeral 1 denotes a user side machine comprising, for example, an absorption type refrigerator (refer to U.S. Pat. No. 5,224,352), which has a cooling function. The user side machine 1 is mounted in a machine room disposed on, for example, the rooftop of the building and gives and receives a heat by a fluid capable of changing a phase between a gas phase and a liquid phase and sealed in a closed circuit 3, for example, a refrigerant R-134*a* which can easily evaporate even at a low temperature when the pressure is lowered, for example, through a heat exchanger 2 disposed within an evaporator.

Reference numeral 5 denotes a heat exchanger of a user side machine 4 mounted on each of the rooms in the building. The heat source side machine 1 and the heat exchangers of the plurality of user side machines 4 are connected by a liquid phase pipe 6 for supplying, a gas phase pipe 7 for returning and flow control valves 8 so as to form the closed circuit 3.

Reference numeral 9 denotes a blower for blowing an air within the room to the heat exchanger S and returning the air within the room, and reference numerals 10 and 11 denote temperature sensors provided in an outlet and an inlet of the heat exchanger 5 for detecting a temperature of the refrigerant R-134*a*. The greater an air conditioning load is, the more a temperature difference between the temperature sensor 10 in the inlet end and the temperature sensor 11 in the outlet end becomes, and the smaller the air conditioning load is, the smaller the temperature difference becomes.

Further, the heat source side machine 1 is provided with a heat source control apparatus 12 and the user side machine 4 is provided with a user control apparatus 13. Further, the user control apparatus 13 is provided with a signal converter (not shown) which can convert a valve opening ratio of the flow control valve 8 and a temperature information detected by the temperature sensors 10 and 11 to a communication signal and can convert a communication signal received from an outer portion into a desired control signal there-within. The heat source control apparatus 12 and the user control apparatus 13 are connected by a communication line 14, and the control signal output from the heat source control apparatus 12 is received by the user control apparatus 13 so as to control the opening ratio of the flow control valve 8. Further, a remote controller 15 which can communicate with the user control apparatus 13 and can perform a starting and stopping operation of a cooling, a select operation of a strength of blowing and a setting operation of a temperature is provided in correspondence to each of the user side machines 4.

At first, a circulating cycle of the refrigerant R-134*a* sealed in the closed circuit 3 will be described below. Since the refrigerant R-134*a* is cooled by the cooling function of the heat source side machine 1 through a pipe wall of the heat exchanger 2, the refrigerant R-134*a* is condensed and stored in the liquid phase pipe 6 in the downstream, and is supplied to each of the heat exchangers 5 through the flow control valve 8 of the user side machine 4.

On the contrary, in each of the heat exchangers 5, since the warm air within the room is forcibly supplied by the blower 9, the refrigerant R-134*a* absorbs the heat from the air within the room and evaporated, thereby performing the cooling.

Then, the refrigerant R-134*a* is cooled so as to be condensed and liquefied, so that a natural circulation is generated by returning the refrigerant R-134*a* to the heat exchanger 2 of the heat source side machine 1 having a low pressure through the gas phase pipe 7.

However, as mentioned above, the more an amount of the refrigerant R-134*a* supplied to the heat exchanger 5 through the flow control valve 8 is, the lower floor the user side machine 4 is mounted on, and the less the amount is, the higher the user side machine is mounted on.

Accordingly, since in the case that the temperature information detected by the temperature sensors 10 and 11 is the same, when the opening ratio is controlled by outputting the same control signal to the flow control valve 8, a suitable amount of the refrigerant R-134*a* can not supplied in response to the cooling load, the heat source control apparatus 12 is provided with a predetermined control program which outputs a different control signal in correspondence to the floor on which the user side machine 4 is mounted, that is, a program of opening the opening ratio of the flow control valve 8 of the user side machine 4 mounted on the higher floor larger. For example, in the case of the air conditioning system in which the user side machines 4 are separately mounted on ten floors, for example, a correction coefficient of the user side machine 4 mounted on the lowest floor is set to 1, a value adding 0.1 to 1 is set to a correction coefficient of the next higher floor and this manner is continued in the next floors. In this state, at first, the opening ratio of the flow control valve 8 at a time of no correction is given is judged by the normal equation on the basis of the temperature information detected by the temperature sensors 10 and 11. Further, the opening ratio of the flow control valve 8 actually output to the user side machine 4 is judged by integrating the desired correction coefficient to the opening ratio. The opening ratio of the flow control valve 8 of the user side machine 4 is adjusted to the opening ratio judged in the above manner.

When the heat source control apparatus 12 receives the temperature information detected by the temperature sensors 10 and 11 from the user control apparatus 13 through the communication circuit 14, at first, the heat source control apparatus 12 confirms what floor the user side machine 4 sending the signal is mounted, and judges the correction coefficient. Taking the correction coefficient judged by this manner into consideration, the opening ratio of the flow control valve 8 is calculated by the predetermined program, the desired control signal is output to the corresponding user control apparatus 13 through the communication circuit 14, and the opening ratio of the flow control valve 8 is adjusted to the opening ratio in correspondence to the floor on which the user side machine is mounted Further, as mentioned above, when the sudden thermal load is generated at a starting time of the cooling, the refrigerant R-134*a* is evaporated in the heat exchanger 5 of the user side machine 4 for a short period of time, so that an internal pressure of the gas phase pipe 7 is increased. Accordingly, it is hard for the refrigerant R-134*a* to flow into the heat exchanger 5, and the gas of the refrigerant R-134*a* returns backward in the flow control valve 8, thereby stopping the absorbing and evaporating phenomenon in the heat exchanger 5. As a result of this, there is a risk that the cooling can not performed.

Accordingly, at a time of starting the cooling, the control signal output from the heat source control apparatus 12 through the communication line 14 to each of the user control apparatus 13 sets the opening ratio of the flow control valve 8 to a fixed low level, for example, an opening ratio of 25% of the full opening ratio for a predetermined period of time, for example, for 30 seconds.

Therefore, even when the air conditioning load is large at a time of starting the cooling and the refrigerant R-134*a* evaporates in the heat exchanger 5 for a short period of time, the amount of the refrigerant R-134*a* supplied through the flow control valve 8 is small, so that the degree of increasing the pressure is limited. Accordingly, the disadvantage that the refrigerant R-134*a* is returned backward in the flow control valve 8 so that the cooling can not be performed, can be avoided.

In this case, the own weight of the refrigerant R-134*a* which discharges heat in the heat exchanger 2 of the heat source side machine 1, is condensed and flows into the heat exchanger 5 of the user side machine 4 acts on the user side machine 4 in a manner that the larger the weight acts on, the lower floor the user side machine 4 is mounted on, so that the refrigerant R-134*a* hardly returns backward in the flow control valve 8. Accordingly, the larger the opening ratio of the flow control valve 8 of the user side machine 4 is opened, the lower floor the user side machine 4 is mounted on, so that the cooling can be started.

In this case, the air conditioning system in accordance with the present invention can be structured such that a receiver tank 16 and an electric pump 17 are provided, as shown in FIG. 1 in a broken line.

In this structure, since a transporting force by the electric pump is added to the difference of the specific gravity between the liquid and the gas of the refrigerant R-134*a*, not only the correction coefficient at a time of determining the opening ratio of the flow control valve 8 can be made smaller, but also the air conditioning system can be constituted by using the flow control valve 8 having a smaller total capacity Further, a part of the user side machines 4 can be mounted on the floor higher than or the same as the floor on which the heat source side machine 1 is mounted. Further, since it is difficult for the refrigerant R-134*a* to flow backward in the flow control valve 8 at a time of starting the cooling, the opening ratio of the flow control valve 8 which is kept for a predetermined period of time is increased and thereby improving a starting characteristic of the air conditioning.

In this case, since the electric pump 17 further secures the circulation of the refrigerant R-134*a* capable of circulating by the difference of the specific gravity between the liquid and the gas, the pump can be significantly made compact in comparison with an electric pump for a heating mentioned below which is required a capacity of transporting the liquid of the refrigerant R-134*a* to the heat source side machine 1 mounted on the higher floor. Accordingly, even when the electric pump 17 is driven so as to perform a cooling operation, the electric power consumption is reduced in comparison with the conventional air conditioning system shown in FIG. 9.

Next, an embodiment of the air conditioning system capable of performing a cooling operation and heating operation will be described below with reference to FIG. 2 The heat source side machine 1 in this case comprises an absorption type refrigerator which has a cooling function and a heating function- Reference numeral 18 denotes a fuel control valve of a burner 19 provided in a regenerator (not shown), reference numeral 20 denotes a cooling/heating switching valve (an opening and closing valve) provided in a common portion 6A of a liquid phase pipe 6, reference numeral 6B denotes a bypass pipe connected to the common portion 6A of the liquid phase pipe so as to bypass the cooling/heating switching valve 20, and reference numerals 21 and 22 denote a receiver tank and an electric pump for a heating provided in the bypass pipe 6B.

In this case, the absorption type refrigerator disclosed in, for example, Japanese Patent Unexamined Publication 7-318189 can be used as the absorption type refrigerator which has a cooling function derived from the heat exchanger 2 provided in the evaporator and also has a heating function.

Namely, in the heat source side machine 1, for example, when the opening ratio of the fuel control valve 18 is increased at a time of performing the heating and heating power is increased by increasing the fuel supplied to the burner 19, the amount of the refrigerant evaporated and separated from the absorption liquid in the regenerator (not shown) is increased. Since the increased refrigerant gas and the heated absorption liquid for evaporating and separating the refrigerant are supplied to the periphery of the heat exchanger 2 so as to discharge the heat to the refrigerant R-134*a* flowing within the heat exchanger 2, the function for heating the refrigerant R-134*a* flowing within the heat exchanger 2 is strengthened, so that the degree of increasing the temperature is increased as far as the flow amount is the same. On the contrast with this, when the opening ratio of the fuel control valve 18 is reduced and the heating power of the burner 19 is reduced, the function of heating the refrigerant R-134*a* flowing within the heat exchanger 2 is weakened, so that the degree of increasing the temperature is decreased On the contrary, when the opening ratio of the fuel control valve 18 is increased at a time of performing the cooling and heating power is increased by increasing the fuel supplied to the burner 19, the amount of the refrigerant evaporated and separated from the absorption liquid (not shown) is increased. Since the increased refrigerant gas discharges the heat in the condenser so as to be condensed, becomes the liquid and is supplied to the periphery of the heat exchanger 2 so as to absorb the heat from the refrigerant R-134*a* flowing within the heat exchanger 2 and thereafter evaporated, the function for cooling the refrigerant R-134*a* flowing within the heat exchanger 2 is strengthened, so that the degree of decreasing the temperature is increased as far as the flow amount is the same. On the contrast with this, when the opening ratio of the fuel control valve 18 is reduced and the heating power of the burner 19 is reduced, the function of cooling the refrigerant R-134*a* flowing within the heat exchanger 2 is weakened, so that the degree of decreasing the temperature is decreased.

In the air conditioning system having the above structure, since the cooling/heating switching valve 20 is closed while maintaining the use of the heating function of the heat source side machine 1, and the refrigerant R-134*a* in the closed circuit 3 is heated by use of the heating function of the heat source side machine 1 through the pipe wall of the heat exchanger 2 when the electric pump 22 is driven, the refrigerant R-134*a* is evaporated and flows into the gas phase pipe 7 so as to be supplied to the heat exchanger 5 in each of the user side machines 4.

In each of the heat exchangers 5, the air within the room having a low temperature is forcibly supplied by the blower 9, the refrigerant R-134*a* discharges the heat to the air within the room so as to be condensed, thereby performing a heating.

Then, the condensed and liquefied refrigerant R-134*a* enters into the receiver tank 21 disposed in the lower portion through the flow control valve 8 and is returned to the heat exchanger 2 of the heat source side machine I by the electric pump 22, so that the circulation for the heating is continued.

In this circulation of the refrigerant R-134*a*, when the heating load in a certain user side machine 4 is increased (or reduced) and the temperature of the refrigerant R-134*a* detected by the temperature sensor 10 in the user side machine 4 is descended (or ascended), the opening ratio of the corresponding flow control valve 8 is increased (or reduced) by receiving the control signal from the user control apparatus 13 in such a manner as to resolve the temperature descent (or the temperature ascent) and the amount of the refrigerant R-134*a* flowing into the heat exchanger 5 of the user side machine 4 increasing (or reducing) the heating load is increased (or reduced) Accordingly, the temperature descent (or ascent) of the refrigerant R-134*a* detected by the temperature sensor 10 is resolved before long.

When the temperature of the refrigerant R-134*a* detected by the temperature sensor 24 or 25 is changed by that the refrigerant R-134*a* having a changed temperature flows into the heat source side machine 1 or that the flow amount of the refrigerant R-134*a* flowing into the heat source side machine 1 is changed due to the change of the heating load, the heat source control apparatus 12 controls the opening ratio of the fuel control valve 18 in such a manner as to resolve the change Further, at a time of the cooling in which the cooling/heating switching valve 20 is opened and the electric pump 22 is stopped, the cooling function of the heat source side machine 1 is used in the above manner, the refrigerant R-134*a* is cooled by use of the cooling function through the pipe wall of the heat exchanger 2 so as to be condensed and discharged to the liquid phase pipe 6, and is supplied to the user side machine 4 through the cooling/heating switching valve 20 and the flow control valve 8 at a predetermined low temperature.

In each of the user side machines 4, since the air within the room having a high temperature is forcibly supplied by the blower 9, the refrigerant R-134*a* in a state of low temperature liquid supplied from the heat source side machine 1 is evaporated by absorbing the heat from the air within the room, and performs a cooling. The gasified refrigerant 9-134*a* is cooled so as to be condensed and liquefied, and flows into the heat exchanger 2 of the heat source side machine 1 having a low pressure through the gas phase pipe 7, so that the natural circulation is generated.

In this circulation of the refrigerant R-134*a*, when the cooling load in a certain user side machine 4 is increased (or reduced) and the temperature of the refrigerant R-134*a* detected by the temperature sensor 11 in the user side machine 4 is ascended (or descended), the opening ratio of the corresponding flow control valve 8 is increased (or reduced) by receiving the control signal from the user control apparatus 13 in such a manner as to resolve the temperature ascent (or the temperature descent) and the amount of the refrigerant R-134*a* flowing into the heat exchanger 5 of the user side machine 4 increasing the cooling load is increased (or reduced). Accordingly, the temperature ascent (or descent) of the refrigerant R-134*a* detected by the temperature sensor 11 is resolved before long When the temperature of the refrigerant R-134*a* detected by the temperature sensor 24 or 25 is changed by that the refrigerant R-134*a* having a changed temperature flows into the heat source side machine 1 or that the flow amount of the refrigerant R-134*a* flowing into the heat source side machine 1 is changed due to the change of the heating load, the heat source control apparatus 12 controls the opening ratio of the fuel control valve 18 in such a manner as to resolve the change.

Namely, the heat source control apparatus 12 of the heat source side machine 1 has a function of controlling the degree of the fuel control valve 18 in such a manner that during the heating, for example, the temperature of the refrigerant R-134*a* detected by the temperature sensor 24, that is, the temperature of the refrigerant R-134*a* which is evaporated by receiving the heating effect in the heat exchanger 2 and discharges to the gas phase pipe 6, becomes a predetermined temperature, for example, 55° C., and a function of controlling the degree of the fuel control valve 18 in such a manner that during the cooling, for example, the temperature of the refrigerant R-134*a* detected by the temperature sensor 25, that is, the temperature of the refrigerant R-134*a* which is condensed by receiving the cooling effect in the heat exchanger 2 and discharges to the gas phase pipe 6, becomes a predetermined temperature, for example, 7° C. Further, the user control apparatus 13 has a function of controlling the degree of the flow control valve 8 in such a manner that during the heating, the temperature of the refrigerant R-134*a* detected by the temperature sensor 10, that is, the temperature of the refrigerant R-134*a* which is condensed by performing the heating effect through the heat exchanger 5, lowers the temperature thereof and discharges to the liquid phase pipe 6, becomes a predetermined temperature, for example, 50° C., and a function of controlling the degree of the flow control valve 8 in such a manner that during the cooling, the temperature of the refrigerant R-134*a* detected by the temperature sensor 11, that is, the temperature of the refrigerant R-134*a* which is evaporated by performing the cooling effect through the heat exchanger 5, increases the temperature thereof and discharges to the gas phase pipe 7, becomes a predetermined temperature, for example, 12° C.

However, as mentioned above, when the sudden thermal load is generated at a time of starting the heating, the supply of the refrigerant R-134*a* evaporated in the heat source side machine 1 to the heat exchanger 5 of the user side machine 4 is not good enough, a so-called sleeping phenomenon of the refrigerant, that is, the condensed the refrigerant R-134*a* is stored in the heat exchanger 5, is generated, so that the cooled air blows within the room. Further, since the amount of the refrigerant R-134*a* sealed in the closed circuit 3 is constant, it is considered that the electric pump 22 is stopped, or the refrigerant R-134*a* from the user side machine 4 is not returned to the heat source side machine 1 Accordingly, there occurs a problem that the pressure in the closed circuit 3 locally increases higher than necessity.

Accordingly, at a time of starting the heating, the control signal output from the heat source control apparatus 12 through the communication line 14 to each of the user control apparatus 13 sets the opening ratio of the flow control valve 8 to a fixed high level, for example, an opening ratio of 75% of the full opening ratio for a predetermined period of time, for example, for 30 seconds.

Therefore, even when the air conditioning load is suddenly increased at a time of starting the heating and the discharging amount of the refrigerant R-134*a* in the heat exchanger 5 suddenly increases, the amount of the refrigerant R-134*a* supplied from the heat source side machine is large, so that the disadvantage that the refrigerant R-134*a* is condensed in the inlet portion of the heat exchanger 5 and the cooled air blows into the room can be avoided.

In this case, since the smaller the difference in level between the liquid of the refrigerant R-134*a* condensed in the heat exchanger 5 and the receiver tank 21, the lower floor the heat exchanger 5 is mounted on, the liquid is hard to be discharged to the receiver tank 21 end. Further, since the lower floor the heat exchanger 5 is mounted on, the lower pressure the refrigerant R-134*a* evaporated in the heat exchanger 2 of the heat source side machine 1 acts on by, the liquid of the refrigerant R-134*a* is hard to be discharged in accordance that the heat exchanger 5 is disposed in the lower floor. Accordingly, it can be structured such that the lower floor the heat exchanger 5 is mounted on, the larger the opening ratio of the flow control valve 8 is opened so as to start the heating.

Further, the more the amount of the refrigerant R-134*a* discharged from the heat exchanger 5 through the flow control valve 8 is, the higher floor the user side machine 4 is mounted on, and the less the amount is, the lower the user side machine 4 is mounted on. Accordingly, also in the heating, at a time of the normal operation without the time of starting, even when the temperature information detected by the temperature sensors 10 and 11 is the same, the heat source control apparatus 12 stores a predetermined control program which outputs a different control signal in correspondence to the floor on which the user side machine 4 is mounted, that is, a program of opening the flow control valve 8 of the user side machine 4 mounted on the lower floor larger at the opening ratio thereof For example, in the case of the air conditioning system in which the user side machines 4 are separately mounted on ten floors, for example, a correction coefficient of the user side machine 4 mounted on the highest floor is set to 1, a value adding 0.05 to 1 is set to a correction coefficient of the next higher floor and this manner is continued in the next floors. In this state, at first, the opening ratio of the flow control valve 8 at a time of no correction is given is judged on the basis of the temperature information detected by the temperature sensors 10 and 11. Further, the opening ratio of the flow control valve 8 actually output to the user side machine 4 is judged by multiplying by the desired correction coefficient to the opening ratio. The opening ratio of the flow control valve 8 of the user side machine 4 is adjusted to the opening ratio judged in the above manner. The opening ratio of the flow control valve 8 of each of the user side machine 4 is controlled by this control program.

When the heat source control apparatus 12 receives the temperature information detected by the temperature sensors 10 and 11 from the user control apparatus 13 through the communication circuit 14, at first, the heat source control apparatus 12 confirms what floor the user side machine 4 sending the signal is mounted, and judges the correction coefficient. Taking the correction coefficient judged by this manner into consideration, the opening ratio of the flow control valve 8 is calculated by the predetermined program, the desired control signal is output to the corresponding user control apparatus 13 through the communication circuit 14, and the opening ratio of the flow control valve 8 is adjusted to the opening ratio in correspondence to the floor on which the user side machine is mounted.

Figure 2:
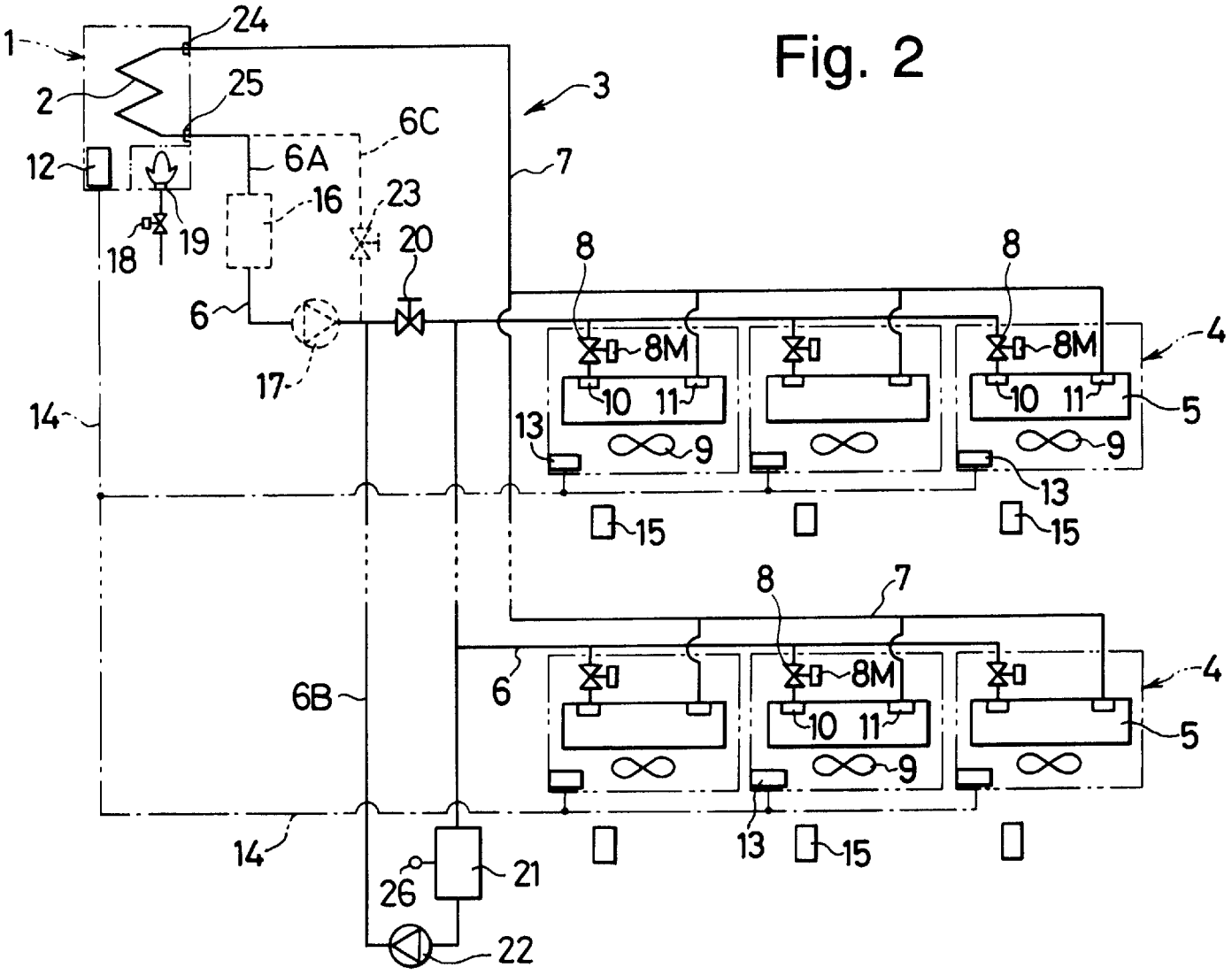
FIG. 2 is a view which explains an air conditioning system constituted for performing a cooling and heating.
Figure 3:
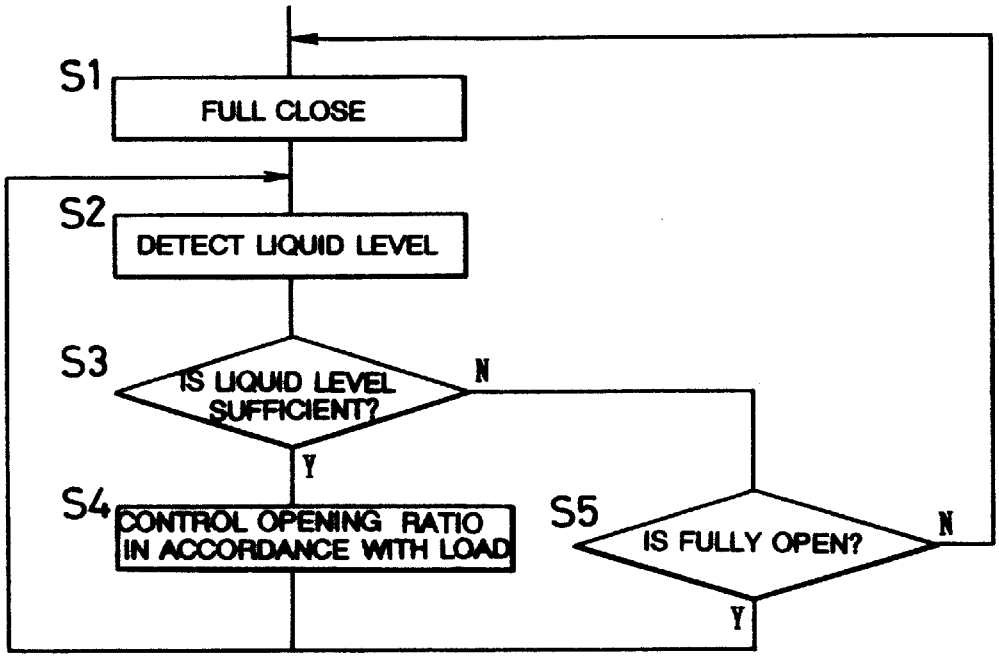
FIG. 3 is a flow chart which shows an example of controlling a flow control valve at a time of starting a heating.

In the air conditioning system capable of performing a cooling operation and heating operation shown in FIG. 2, by providing with the receiver tank 16 and the electric pump 17 as shown in a broken line, the refrigerant R-134*a* can be securely circulated for the cooling even when a part of the user side machines 4 are disposed on the same floor as that of the heat source side machine 1 or the floor higher than that of the heat source side machine 1 In this case, it is preferable that a bypass pipe 6C provided with a cooling/heating switching valve (an opening and closing valve) 23 which is opened at a time of performing the heating and closed at a time of performing the cooling is connected to the liquid phase pipe common portion 6A in a manner shown in a broken line.

Further, at a time of starting the heating, a great amount of the refrigerant R-134*a* is condensed within the cooled closed circuit 3 and the circulating of the refrigerant R-134*a* is insufficient so that there frequently occurs the case that sufficient heating is not performed. During the operation, the refrigerant R-134*a* is condensed in the cooled part of the closed circuit 3 and the circulating of the refrigerant R-134*a* is insufficient so that there occurs the case that sufficient heating is not performed. Accordingly, the opening ratio of the flow control valve 8 may be controlled by the heat source control apparatus 12, for example, in such a manner shown in FIG. 3.

Namely, when the heating is commanded, in a step S1, the flow control valves 8 in all the user side machines 4 are fully opened. Continuously, the step goes to a step S2, an amount of R-134 stored in the receiver tank 21 is detected by a liquid level sensor 26. Then, in a step S3, whether or not the amount of the refrigerant R-134*a* stored in the receiver tank 21 is sufficient is judged. When the step judges that the amount is sufficient, the step goes to a step S4 and the opening ratio of the flow control valve 8 is controlled on the basis of the heating load, concretely, the temperature of the refrigerant R-134*a* detected by the temperature sensor 10. When the step judges that the amount is insufficient, the step goes to a step 55 and whether or not the flow control valve 8 is fully opened is judged. Then, when the flow control valve 8 is fully opened, the step goes back to the step S2, and when the flow control valve 8 is not fully opened, the step goes back to the step S1 and the flow control valve 8 is made fully open.

Since the flow control valves 8 are controlled by the heat source control apparatus 12 in the above manner, when a great amount of the refrigerant R-134*a* is condensed in the closed circuit 3 so as to sleep or start sleeping, the condensed liquid is pushed out to the liquid phase pipe 6 through the flow control valve 8 which is fully opened at necessity by the gas pressure of the refrigerant R-134*a* heated and gasified by the heat exchanger 2 of the heat source side machine 1 so as to be stored in the receiver tank 21, and then is returned back to the heat source side machine 1 by the electric pump 22. Accordingly, the amount of the circulating the refrigerant R-134*a* is immediately increased, so that the heating performance is early recovered.

Further, as mentioned above, the lower floor the user side machine 4 is mounted on, the more the own weight of the refrigerant R-134*a* which discharges the heat in the heat exchanger 2 and is condensed at a time of the cooling, and flows into the heat exchanger 5 of the user side machine 4 acts on the user side machine 4, and the higher the user side machine 4 is mounted on, the less the own weight thereof acts on the user side machine 4. Accordingly, even when the opening ratio is the same, the lower floor the user side machine 4 is mounted on, the more the amount of the refrigerant R-134*a* supplied to the heat exchanger 5 through the flow control valve 8 is, and the higher the user side machine 4 is mounted on, the less the amount thereof is. Furthermore, even when the user side machines 4 are mounted on the same floor, the refrigerant R-134*a* flows into the user side machine 4 disposed near the heat source side machine 1 in an easier manner than the user side machine 4 disposed apart from the heat source side machine 1 in view of a resistance in the flow passage. The degree of flowing difficulty of the refrigerant R-134*a* is influenced in accordance with the difference of the internal diameter or the pipes and the curvature at arranging the pipes.

Still further, since there is a resistance due to boiling of the refrigerant R-134*a* in the liquid phase pipe 6, even when the opening ratio of the flow control valve 8 is corrected and controlled on the basis of the place of the devices, it takes long time until the temperature is stable. Since the boiling of the refrigerant R-134*a* in the liquid phase pipe 6 is influenced by the circulating amount, the phase is continuously changed.

For example, in the user side machine 4 having a large resistance due to the bubble mixture by boiling, the circulating amount of the refrigerant R-134*a* is a little, so that even when the flow control valve 8 is opened any more, there is a case that the difference between the temperatures is not reduced. In this case, the circulating amount of the refrigerant R-134*a* to this portion is reduced by slightly closing the flow control valve 8 of the other user side machine 4 at the opening ratio thereof, so that the circulating amount of the refrigerant R-134*a* to the user side machine 4 having a reduced flow amount is increased so as to prevent the refrigerant R-134*a* from boiling, thereby controlling in such a manner as to return the resistance back to the original level.

Namely, when the user control apparatus 12 receives the temperature information detected by the temperature sensors 10 and 11 in all the user side machines 4 now operating through the communication line 14 from the user control apparatus 13, at first the user control apparatus 12 judges a difference $|t_1-t_0|$ between the temperature $t_1$ detected by the temperature sensor 11 and the temperature $t_0$ detected by the temperature sensor 10 with respect to all the user side machines 4 such as $\Delta T_1$, $\Delta T_2$, $\Delta T_3$, $\Delta T_4$, . . . $\Delta T_n$. Next, $\Delta T_i$ which corresponds to the maximum value of ($|t_1-t_0|$) is selected, for example, at every 10 seconds, and when the time period for which the $\Delta T_i$ maintains to be the maximum reaches a predetermined time (for example, 30 seconds), the following adjustment is performed in the user side machines other than the corresponding user side machine.

Namely, in the case that the difference ($t_1-t_0$) is equal to or more than a predetermined value, for example, 3° C., as a first forcible adjustment, the control signal for forcibly operating each of the stepping motor 8M performing the adjustment of the opening ratio of the flow control valve 8 at a predetermined steps in a direction that the flow control valve 8 of the user side machines 4 other than the selected user side machine 4 are closed is output to each of the user control apparatus 13 through the communication circuit 14, thereby forcibly controlling the opening ratio K of each of the flow control valves 8

Further, in the case that the difference $(t_1-t_0)$ is equal to or less than a predetermined value, for example, −3° C. for a predetermined period of time, as a second forcible adjustment, the control signal for forcibly operating each of the stepping motor 8M at a predetermined steps in a direction that the flow control valve 8 of the user side machines 4 other than the selected user side machine 4 are opened is output to each of the user control apparatus 13 through the communication circuit 14, thereby forcibly controlling the opening ratio K of each of the Flow control valves 8

For example, in the case that the temperature of the air which is taken into the user side machine 4 by the blower 9 and is blown to the heat exchanger 5, that is, the room temperature is equal to or higher than the temperature set by the remote controller 15, $\Delta T_{tgt}=1$ is set, and in the other cases, $\Delta T_{tgt}=3$ is set. Then, the forcibly adjusting control at a time of performing the cooling is performed by controlling the opening ratio K of each of the flow control valve 8 in such a manner that the difference of the temperature ΔT between the temperature $t_1$ of the refrigerant R-134*a* detected by the temperature sensor 11 and the temperature $t_0$ of the refrigerant R-134*a* detected by the temperature sensor 10 becomes $\Delta T_{tgt}$. An example of this forcibly adjusting control will be described below with reference to FIG. 4.

In a step S11 at first, in each of the user side machines 4, whether or not the room temperature is equal to or more than the set temperature is judged. When the step judges yes, the step goes to a step S12 and $\Delta T_{tgt}=1$ is set. When the step judges no, the step goes to a step S13 and $\Delta T_{tgt}=3$ is set.

In a step S14, whether or not the temperature difference ΔT is equal to or more than zero is judged- When the step judges yes, the step goes to a step S15 and whether or not $\Delta T \geqq \Delta T_{tgt}$ is judged. When the step judges no, the step goes to a step S16 and ΔK1=0 is set.

When the step S15 judges yes, the step goes to a step S17 and for example, $\Delta K1=(\Delta T-\Delta T_{tgt})/4$ is set. When the step judges no, the step goes to a step S18 and for example, $\Delta K1=-\alpha$ (in which α is judged, for example, within a range of 0.2 to 2.4 at a time of mounting the air conditioning system with taxing the power into consideration) is set.

In a step S19, whether or not the command of forcibly adjusting is output from the heat source control apparatus 12 is judged. When the step judges yes, the step goes to a step S20 and $\Delta K2=\beta$ (in which β is, for example, −2 in the case of performing the first forcible adjustment and is, for example, +2 in the case of performing the second forcible adjustment) is set. When the step judges no, the step goes to a step S21 and ΔK2=0 is set.

Then, in a step S22, the opening ratio K of the flow control valve 8 is controlled to $K+\Delta K1+\Delta K2$ and the control is repeated at every 10 seconds by a step S23.

Accordingly, for example, in the case of the user side machine 4 in which the resistance is increased by a mixture of the bubbles generated by the boiling, the flow amount of the refrigerant R-134*a* is not increased even when the flow control valve 8 is fully opened and the temperature difference of the refrigerant R-134*a* at the outlet and inlet portion of the heat exchanger 5 is not reduced, the opening ratio of the flow control valve 8 of the other user side machines 4 normally operating is slightly closed on the basis of the forcibly adjusting command output by the heat source control apparatus 12, the amount of the refrigerant R-134*a* flowing to the user side machines 4 normally operating is reduced and the distribution amount of the refrigerant R-134*a* to the user side machine 4 in which the flow amount is reduced is increased so that the boiling is prevented. Accordingly, the resistance returns to the normal level and the same air conditioning performance as that of the other user side machines 4 can be quickly secured Further, even when the refrigerant R-134*a* easily flows for some reasons so that there is the user side machine 4 having the heat exchanger 5 being in a state of abnormally supercooled, the opening ratio of the flow control valve 8 of the other user side machines 4 normally operating is slightly increased on the basis of the forcibly adjusting command output by the heat source control apparatus 12, the amount of the refrigerant R-134*a* flowing to the user side machines 4 normally operating is increased and the distribution amount of the refrigerant R-134*a* to the user side machine 4 in which the flow amount is increased is reduced so that the air conditioning performance is restricted to the level of that of the other user side machines 4.

Still further, the heat source control apparatus 12 may control the opening ratio of the flow control valve 8 in the following manner. Namely, when the user control apparatus 12 receives the temperature information detected by the temperature sensors 10 and 11 in all the user side machines 4 now operating through the communication line 14 from the user control apparatus 13, at first the user control apparatus 12 judges a difference $(t_1-t_0)$ between the temperature $t_1$ detected by the temperature sensor 11 and the temperature $t_0$ detected by the temperature sensor 10 with respect to all the user side machines 4 such as $\Delta T_1$, $\Delta T_2$, $\Delta T_3$, $\Delta T_4$, . . . , and next, an average temperature difference $\Delta T_M$ is judged Then, the difference $(\Delta T_i-\Delta T_M)$ between each of the temperature difference $\Delta T_i$ and the average temperature difference $\Delta T_M$ $(=(\Delta T_1+\Delta T_2+\Delta T_3+ \ldots +\Delta T_n)/n)$ is judged at every 10 seconds when the difference is equal to or more than a predetermined value, for example, 2° C., as a first forcible adjustment, the control signal for forcibly operating the stepping motor 8M at a predetermined steps in a direction that the flow control valve 8 of the corresponding user side machine 4 is opened is output to the corresponding user control apparatus 13 through the communication circuit 14, thereby forcibly controlling the opening ratio K of the flow control valves 8.

Further, in the case that the difference $(\Delta T_1-\Delta T_M)$ is equal to or less than a predetermined value, for example, −2° C. for a predetermined period of time, as a second forcible adjustment, the control signal for forcibly operating the stepping motor 8M at a predetermined steps in a direction that the flow control valve 8 of the corresponding user side machine 4 is closed is output to the corresponding user control apparatus 13 through the communication circuit 14, thereby forcibly controlling the opening ratio K of the flow control valves 8.

For example, in the case that the temperature of the air which is taken into the user side machine 4 by the blower 9 and is blown to the heat exchanger 5, that is, the room temperature is equal to or higher than the temperature set by the remote controller 15, $\Delta T_{tgt}=1$ is set, and in the other cases, $\Delta T_{tgt}=3$ is set. Then, the forcibly adjusting control at a time of performing the cooling is performed by controlling the opening ratio K of each of the flow control valve 8 in such a manner that the difference of the temperature ΔT between the temperature $t_1$ of the refrigerant R-134*a* detected by the temperature sensor 11 and the temperature $t_0$ of the refrigerant R-134*a* detected by the temperature sensor 10 becomes $\Delta T_{tgt}$. Accordingly, by performing the forcibly adjusting control on the basis of the same flow chart as that of FIG. 4, in the user side machine 4 in which the temperature difference of the refrigerant R-134*a* at the outlet and inlet portion of the user side machine 4 is significantly different from the average temperature difference, the flow control valve 8 is forcibly adjusted on the basis of the forcible adjustment command output by the heat source control apparatus 12, so that the same air conditioning performance can be secured in all the user side machines 4.

Further, when the user control apparatus 12 receives the temperature information detected by the temperature sensors 10 and 11 in all the user side machines 4 operating at a time of the heating through the communication line 14 from the user control apparatus 13, at first the user control apparatus 12 judges a difference $(t_1-t_0)$ between the temperature $t_1$ detected by the temperature sensor 11 and the temperature $t_0$ detected by the temperature sensor 10 with respect to all the user side machines 4 such as $\Delta T_1$, $\Delta T_2$, $\Delta T_3$. $\Delta T_4$, . . . $\Delta T_n$. Next, $\Delta T_i$ which corresponds to the maximum value of $(t_1-t_0)$ is selected, for example, at every 10 seconds and when the time period for which the $\Delta T_i$ maintains to be the maximum reaches a predetermined time (for example, 30 seconds), the following adjustment is performed in the user side machines other than the corresponding user side machine.

In the case that the difference $(t_1-t_0)$ is equal to or more than a predetermined value, for example, 3° C., as a forcible adjustment, the control signal for forcibly operating each of the stepping motor 8M at a predetermined steps in a direction that the flow control valve B of the user side machines other than the selected user side machine 4 are closed is output to each of the user control apparatus 13 through the communication circuit 14, thereby forcibly controlling the opening ratio K of each of the flow control valves 8.

For example, in the case that the temperature of the air which is taken into the user side machine 4 by the blower 9 and is blown to the heat exchanger 5, that is, the room temperature is equal to or lower than the temperature set by the remote controller 15, $\Delta T_{tgt}=1$ is set, and in the other cases, $\Delta T_{tgt}=3$ is set. Then, the forcibly adjusting control at a time of performing the heating is performed by controlling the opening ratio K of each of the flow control valve 8 in such a manner that the difference of the temperature ΔT between the temperature $t_1$ of the refrigerant R-134*a* detected by the temperature sensor 11 and the temperature $t_0$ of the refrigerant R-134*a* detected by the temperature sensor 10 becomes $\Delta T_{tgt}$. An example of this forcibly adjusting control will be described below with reference to FIG. 5.

In a step S31, at first, in each of the user side machines 4, whether or not the room temperature is equal to or less than the set temperature is judged. When the step judges yes, the step goes to a step S32 and $\Delta T_{tgt}=1$ is set. When the step judges no, the step goes to a step S33 and $\Delta T_{tgt}=3$ is set.

In a step S34, whether or not the temperature difference ΔT is equal to or more than zero is judged. When the step judges yes, the step goes to a step S35 and whether or not $\Delta T \geqq \Delta T_{tgt}$ is judged. When the step judges no, the step goes to a step S36 and ΔK1=0 is set.

When the step S35 judges yes, the step goes to a step S37 and for example, $\Delta K1=(\Delta T-\Delta T_{tgt})/4$ is set. When the step judges no, the step goes to a step S38 and for example, ΔK1=α (in which α is judged, for example, within a range of 0.2 to 2.4 at a time of mounting the air conditioning system with taking the power into consideration) is set.

In a step S39, whether or not the command of forcibly adjusting is output from the heat source control apparatus 12 is judged. When the step judges yes, the step goes to a step S40 and ΔK2=2 is set. When the step judges no, the step goes to a step S41 and ΔK2=0 is set.

Then, in a step S42, the opening ratio K of the flow control valve 8 is controlled to K+ΔK1+ΔK2 and the control is repeated at every 10 seconds by a step S43.

Accordingly, at a time of performing the heating, in the case of the user side machine 4 in which the resistance is increased by a mixture of the bubbles generated by the boiling, the flow amount of the refrigerant R-134*a* is not increased even when the flow control valve 8 is fully opened and the temperature difference of the refrigerant R-134*a* at the outlet and inlet portion of the heat exchanger 5 is not reduced, the opening ratio of the flow control valve 8 of the other user side machines 4 normally operating is slightly decreased on the basis of the forcibly adjusting command output by the heat source control apparatus 12, the amount of the refrigerant R-134*a* flowing to the user side machines 4 normally operating is reduced and the distribution amount of the refrigerant R-134*a* to the user side machine 4 in which the flow amount is reduced is increased. Accordingly, the same air conditioning performance as that of the other user side machines 4 can be quickly secured.

Still further, the heat source control apparatus 12 may control the opening ratio of the flow control valve 8 at a time of performing the heating in the following manner. Namely, when the user control apparatus 12 receives the temperature information detected by the temperature sensors 10 and 11 in all the user side machines 4 now operating through the communication line 14 from the user control apparatus 13, at first the user control apparatus 12 judges a difference $(t_1-t_0)$ between the temperature $t_1$ detected by the temperature sensor 11 and the temperature $t_0$ detected by the temperature sensor 10 with respect to all the user side machines 4 such as $\Delta T_1$, $\Delta T_2$, $\Delta T_3$, $\Delta T_4$, . . . and next, an average temperature difference $\Delta T_M$ is judged.

Then, the difference $(\Delta T_1-\Delta T_M)$ between each of the temperature difference $\Delta T_1$ and the average temperature difference $\Delta T_M$ $(=(\Delta T_1+\Delta T_2+\Delta T_3+ \ldots +\Delta T_n)/n)$ is judged at every 10 seconds When the difference is equal to or more than a predetermined value, for example, 2° C., as a first forcible adjustment, the control signal for forcibly operating the stepping motor 8M at a predetermined steps in a direction that the flow control valve 8 of the corresponding user side machine 4 is opened is output to the corresponding user control apparatus 13 through the communication circuit 14, thereby forcibly controlling the opening ratio K of the flow control valves B.

Further, in the case that the difference $(\Delta T_1-\Delta T_M)$ is equal to or less than a predetermined value, for example, −2° C. for a predetermined period of time, as a second forcible adjustment, the control signal for forcibly operating the stepping motor 8M at a predetermined steps in a direction that the flow control valve 8 of the corresponding user side machine 4 is closed is output to the corresponding user control apparatus 13 through the communication circuit 14, thereby forcibly controlling the opening ratio K of the flow control valves 8.

For example, in the case that the temperature of the air which is taken into the user side machine 4 by the blower 9 and is blown to the heat exchanger 5, that is, the room temperature is equal to or lower than the temperature set by the remote controller 15, $\Delta T_{tgt}=1$ is set, and in the other cases, $\Delta T_{tgt}=3$ is set. Then, the forcibly adjusting control at a time of performing the heating is performed by controlling the opening ratio K of each of the flow control valve 8 in such a manner that the difference of the temperature ΔT between the temperature $t_1$ of the refrigerant R-134*a* detected by the temperature sensor 11 and the temperature $t_0$ of the refrigerant R-134*a* detected by the temperature sensor 10 becomes $\Delta T_{tgt}$. Accordingly, by performing the forcibly adjusting control in which ΔK in the step S40 is +2 in the case of performing the first forcible adjustment and ΔK in the step S40 is −2 in the case of performing the second forcible adjustment on the basis of the same flow chart as that of FIG. 5, in the user side Machine 4 in which the temperature difference of the refrigerant R-134*a* at the outlet and inlet portion of the user side machine 4 is significantly different from the average temperature difference, the flow control valve 8 is forcibly adjusted on the basis of the forcible adjustment command output by the heat source control apparatus 12, so that the same air conditioning performance can be secured in all the user side machines 4.

In this cases the average temperature difference $\Delta T_M$ which corresponds to a standard at a time of forcibly changing the opening ratio of the flow control valve 8 is not only an arithmetic average but also a geometrical average Further, a median can be employed. Still further, the average value or the median among optionally selected plural number, for example, when the number of the user side machines 4 is ten (10), the average value or the median of the half thereof five (5) or of optionally selected five (5) to ten (10) user side machines in the case that the number of the user side machines is more than ten (10) can be employed.

Figure 6:
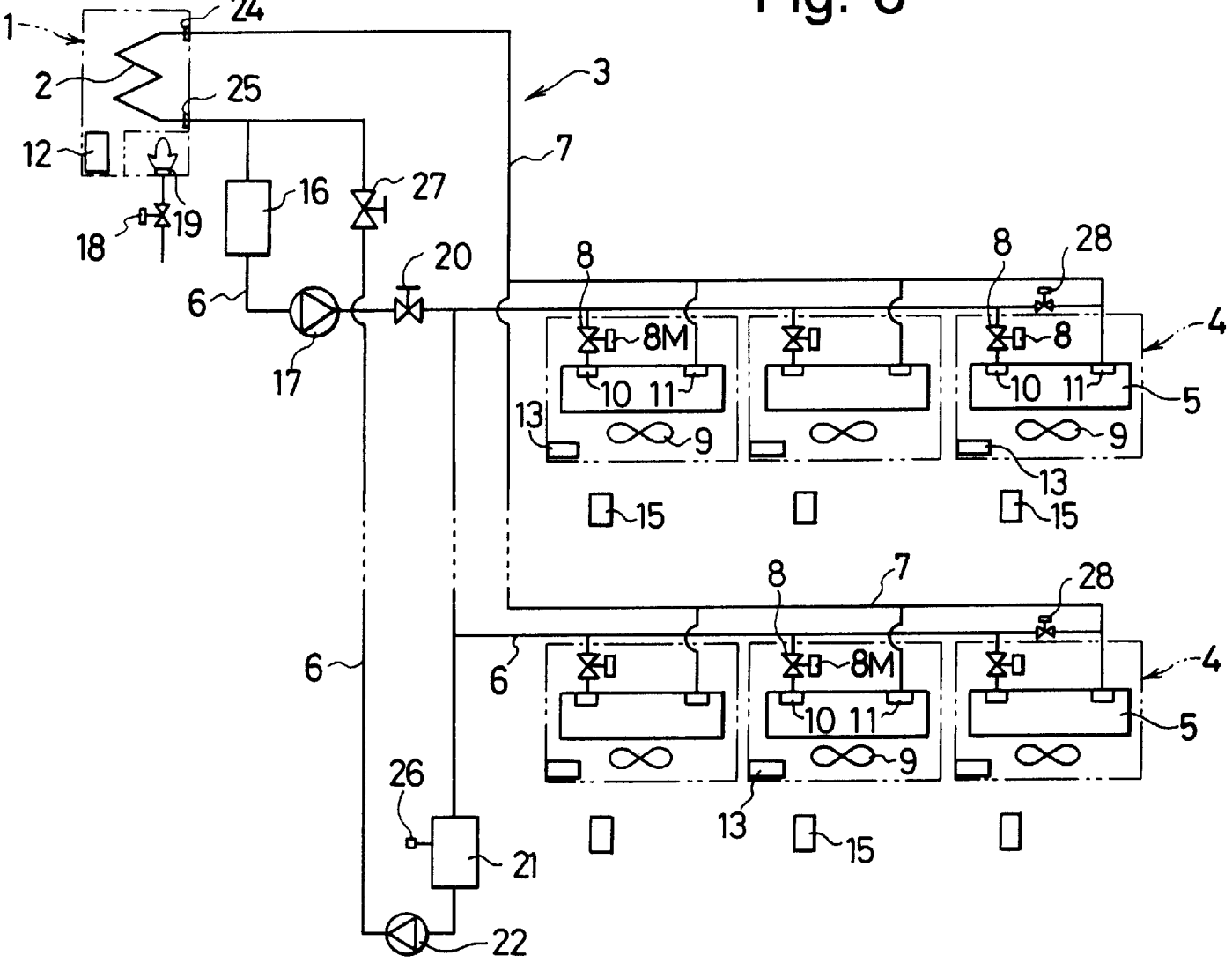
FIG. 6 is a view which explains another air conditioning system constituted for performing a cooling and heating.

The air conditioning system shown in FIG. 6 is structured such that the receiver tank 16 and the electric pump 17 as shown in FIG. 2 in a broken line are provided, the discharge end of the electric pump 22 is connected to the inlet end of the receiver tank 16 through an opening and closing valve 27, and the ends of the horizontal extension pipes of the liquid phase pipe 6 and the gas phase pipe 7 which are respectively extended in a divided manner to a horizontal direction from the thick vertical pipe serving as a main pipe extending in a vertical direction of the liquid phase pipe 6 and the gas phase pipe 7 are connected to each other through an opening and closing valve 28. In this structure, the heating is performed by closing the cooling/heating switching valve 20, opening the opening and closing valve 27, stopping the electric pump 17 and driving the electric pump 22, and the cooling is performed by opening the cooling/heating switching valve 20, closing the opening and closing valve 27, stopping the electric pump 22 and driving the electric pump 17. Accordingly, in the heating and the cooling, when the opening and closing valve 28 is closed, the refrigerant R-134*a* within the closed circuit 3 circulates in the same manner as that in the case of the air conditioning system shown in FIG. 2.

In the air conditioning system having the above structure, since the refrigerant R-134*a* transported toward the heat source side machine 1 by the electric pump 22 at a time of the heating does not pass the electric pump 17, there is an advantage that the transporting resistance is smaller than that of the air conditioning system having the structure shown in FIG. 2.

Figure 7:
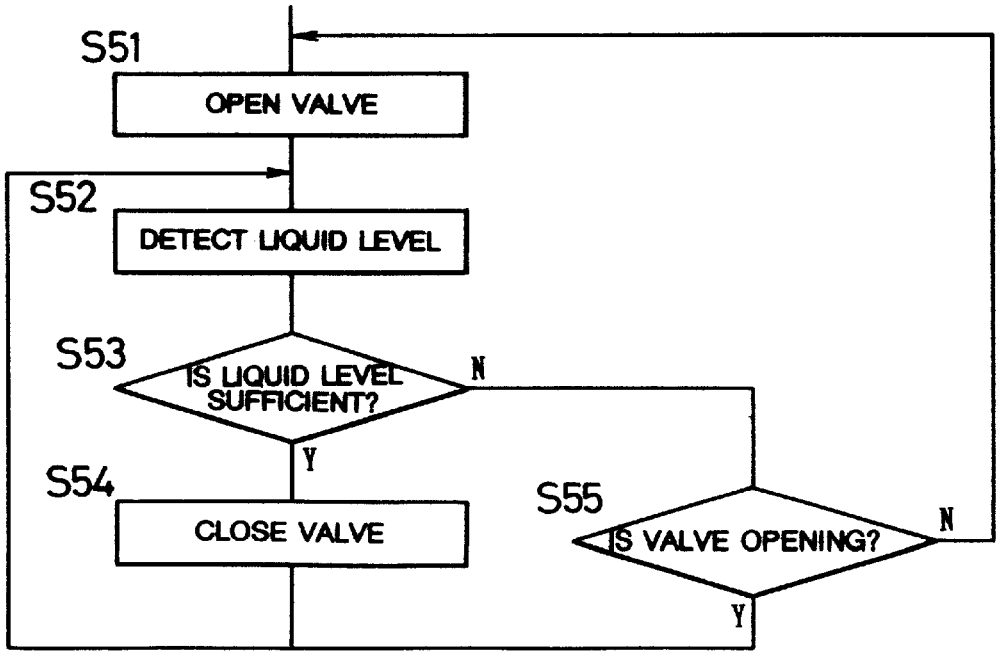
FIG. 7 is a flow chart which shows an example of controlling an opening and closing valve of the air conditioning system shown in FIG. 6.
Figure 4:
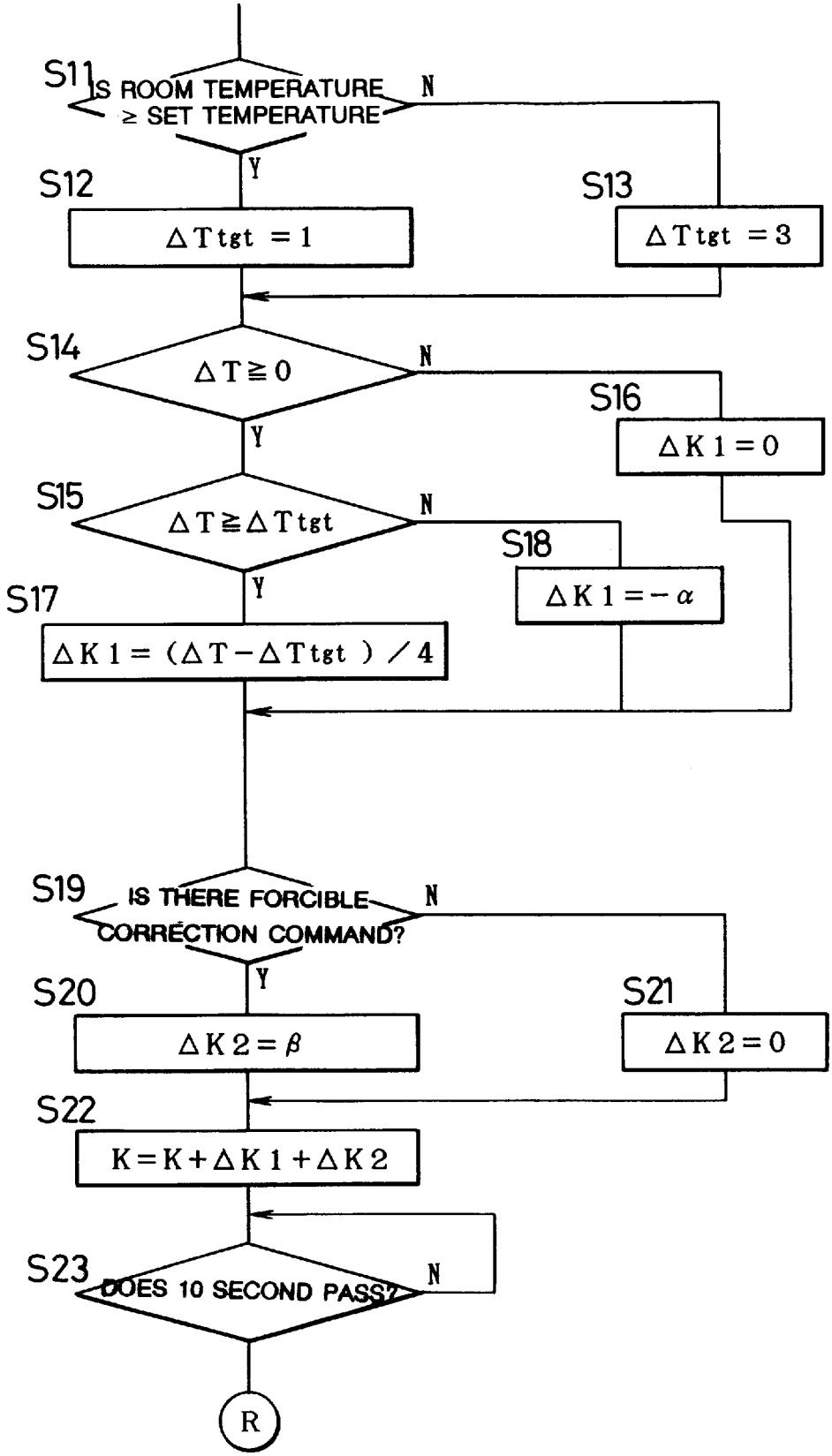
FIG. 4 is a flow chart which shows an example of controlling a flow control valve at a time of performing a cooling.
Figure 5:
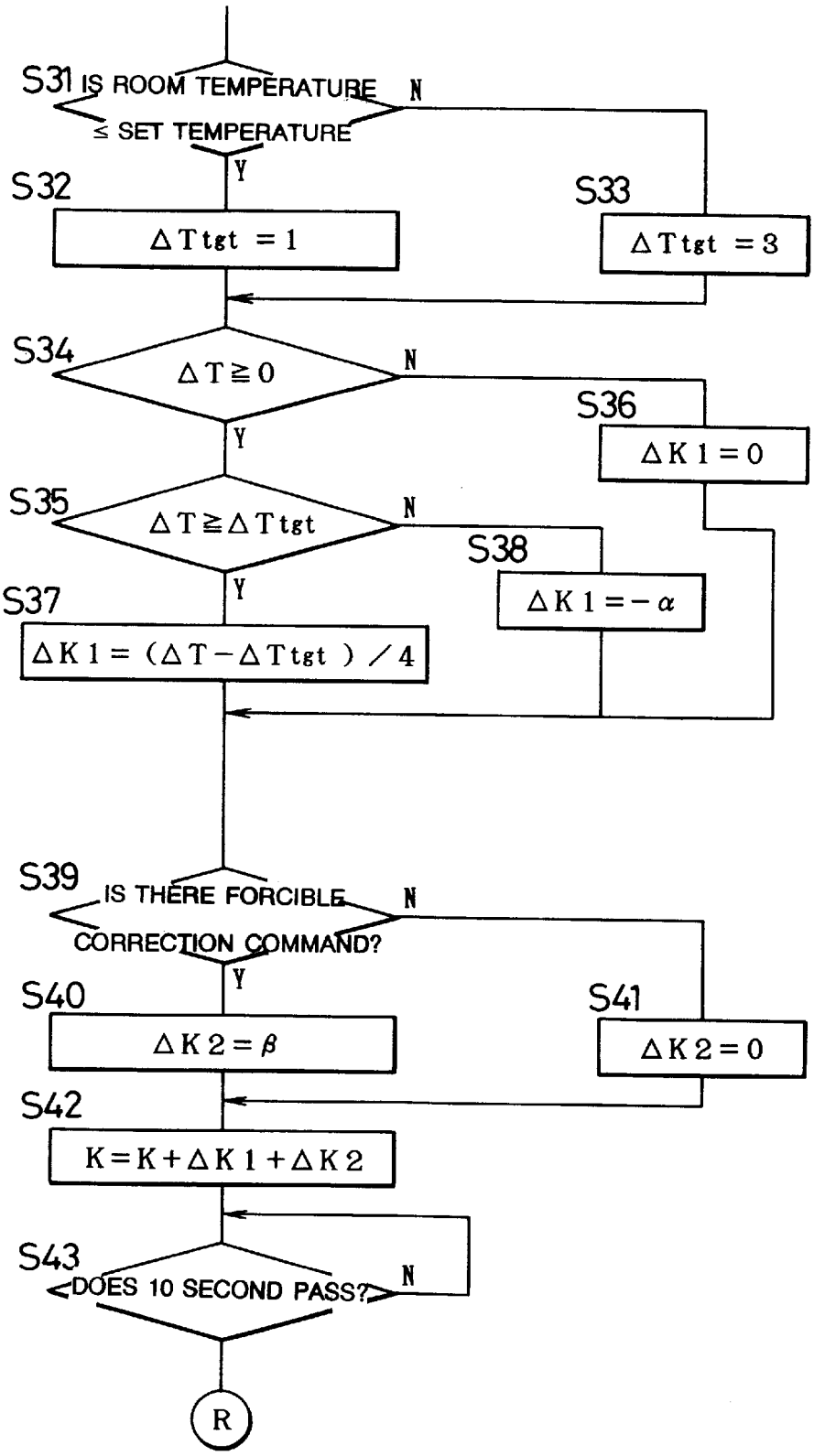
FIG. 5 is a flow chart which shows an example of controlling a flow control valve at a time of performing a heating.

Further, in the heating of the air conditioning system having the above structure, the opening and closing valve 28 is controlled, for example, in a manner shown in FIG. 7.

Namely, when the heating is commanded, in a step S51, all the opening and closing valves 28 are fully opened Continuously, the step goes to a step S52, an amount of R-134 stored in the receiver tank 21 is detected by a liquid level sensor 26. Then, in a step S53, whether or not the amount of the refrigerant R-134*a* stored in the receiver tank 21 is sufficient is judged. When the step judges that the amount is sufficient, the step goes to a step S54 and the opening and closing valve 28 is closed. When the step judges that the amount is insufficient, the step goes to a step S55 and whether or not the opening and closing valve 28 is now going to be opened is judged. Then, when the opening and closing valve 28 is now going to be opened, the step goes back to the step S52, and when the flow control valve 8 is now going to be closed, the step goes back to the step S51.

Due to the above control of the opening and closing valve 28, when a great amount of the refrigerant R-134*a* is condensed in the closed circuit 3 so as to sleep or start sleeping, the condensed liquid is pushed out to the liquid phase pipe 6 through the opening and closing valve 28 which is opened at necessity by the gas pressure of the refrigerant R-134*a* heated and gasified by the heat exchanger 2 of the heat source side machine 1 so as to be stored in the receiver tank 21, and then is returned back to the heat source side machine 1 by the electric pump 22 Accordingly, the amount of the circulating the refrigerant R-134*a* is immediately increased, so that the heating performance is early recovered.

The present invention is not limited to the above embodiments and various kinds of modified embodiments can be realized within the scope of the invention as recited in claims.

For example, the temperature sensors 10 and 11 can be provided in such a manner as to detect the temperature change of the air within the room to be blown to the heat exchanger 5. A pressure sensor for detecting the pressure difference of the refrigerant R-134*a* in the outlet and inlet portions of the heat exchanger can be provided in place of the temperature sensors 10 and 11, thereby outputting the load of the air conditioning to the heat source control apparatus 12.

Further, as the fluid capable of changing the phase and sealed in the closed circuit 3, in addition to the refrigerant R-134*a*, R-407*c*, R-404A, R-410*c* or the like which can be moved by a latent heat may be employed.

As mentioned above, since the air conditioning system in accordance with the present invention is structured such that the user side machine is provided with the heat exchanger, the flow control valve for controlling an amount of the fluid capable of changing the phase and supplied to the heat exchanger, the blow means for supplying the air within the room to the heat exchanger, the physical value detecting means for detecting the physical value such as the temperature and the signal controlling means connected to the above operating and detecting means, and the heat source side machine is provided with the control means for communicating with the signal controlling means and outputting the control signal to the flow control valve, even in the case that the cooling load is the same, the opening ratio of the flow control valve of the user side machine mounted on the higher floor can be controlled so as to be greater than that of the user side machine mounted on the lower floor In accordance with the above structure, the air conditioning characteristic in the air conditioning system which is basically controlled by a natural circulation and in which it is hard to supply the fluid to the user side machine mounted on the higher floor, so that it is hard to operate the air conditioning can be improved.

Further, in the air conditioning system in which the opening ratio of the flow control valve is held at a predetermined small opening ratio for a predetermined time period at a time of starting a cooling, even when the cooling load at a time of starting is large and the fluid evaporates in the user side machine for a short time, the amount of the fluid supplied to the user side machine through the flow control valve is small. Accordingly, the degree of increasing the pressure is limited, so that the disadvantage that the cooling can not performed by that the fluid is returned back in the flow control valve at a time of starting the cooling can be avoided.

Further, in the air conditioning system in which the opening ratio of the flow control valve is held at a predetermined large opening ratio for a predetermined time period at a time of starting a heating, even when the heating load is suddenly increased at a time of starting, the amount of supplying the fluid is not insufficient. Accordingly, the disadvantage that the fluid is condensed in the inlet portion of the heat exchanger of the user side machine so that the cold air blows into the room as In the case of the conventional art can be avoided.

In the air conditioning system in which the opening ratio of the flow control valve is almost fully opened at a time of detecting an insufficiency in the circulating amount of said fluid during the heating, or the air conditioning system in which the opening and closing valve connecting the end portions of the division pipes to each other is opened, when a great amount of the fluid capable of changing the phase is condensed in the closed circuit at a time of starting the heating so as to sleep or start sleeping during the operation, the condensed liquid is heated by the heat source side machine and is pushed out to the liquid phase pipe through the flow control valve or the opening and closing valve, thereby being returned back to the heat source side machine by the electric pump provided in the liquid phase pipe. Accordingly, the amount of the circulating fluid is immediately increased, so that the heating performance is early recovered. As a result of this, it is unnecessary to charge the great amount of fluid to the closed circuit with considering the sleep in the conventional case.

Still further in the air conditioning system in which when the physical value detecting means recognizes a state that the inlet or outlet temperature of the fluid flowing in the effectively operating user side machines or the difference of the physical value effected by the temperature difference is significant in comparison with that of the plurality of the other effectively operating user side machines continues for a predetermined time period, the flow control valve of the plurality of the other user side machines can be adjusted in a direction of resolving said significant state of the user side machine in the significant state, even when the fluid easily flows for some reasons so that there is the user side machine in a state of abnormally super-cooled, the opening ratio of the flow control valve of the other user side machines normally operating is slightly opened on the basis of the forcibly adjusting command output by the heat source side machine, the amount of the fluid flowing to the user side machines normally operating is increased and the distribution amount of the fluid to the user side machine in which the flow amount is increased is reduced so that the air conditioning performance is restricted to the level of that of the other user side machines 4.

Further, in the air conditioning system in which when said physical value detecting means recognizes a state that an inlet or outlet temperature of the fluid flowing in the effectively operating user side machines or a difference of the physical value effected by the temperature difference is significant in comparison with that of the plurality of the other effectively operating user side machines continues for a predetermined time period, said the flow control valve of said user side machines is adjusted in a direction of resolving said significant state, when the temperature difference of the fluid capable of changing the phase at the outlet and inlet portion and circulated and supplied to the user side machine is significantly different from the average temperature difference, the opening ratio of the flow control valve in correspondence to the user side machine is forcibly adjusted, so that the same air conditioning performance can be secured in all the user side machines.

Further, as shown in the embodiment, in the air conditioning system in which an absorbing cooling and heating apparatus having a cooling function and a heating function by burning the gas or the oil is employed as the heat source side machine, only the electric power for controlling the control devices or driving the auxiliary pump for the cooling is used for the electric power at a time of performing the cooling, so that the electric poser can be effectively reduced in the summer at which the amount of generating the electric power is maximum.

What is claimed is:

1. An air conditioning system for circulating a fluid which can change a phase between a gas phase and a liquid phase by a difference of a specific gravity between the gas phase and the liquid phase between a heat source side machine and a plurality of user side machines more than half of which are disposed below the heat source side machine, so that each of the user side machines performs a cooling operation, wherein each of the user side machines is provided with a heat exchanger, a flow control valve for controlling a volume of said fluid supplied to the heat exchanger, a blow means for supplying an air-conditioned air to a room through the heat exchanger, a physical value detecting means for detecting a physical value relating to an air-conditioned load such as a temperature and a signal controlling means for the heat exchanger, the flow control valve, the blow means and the physical value detecting means, and wherein the heat source side machine has a control means for communicating with said signal controlling means and outputting a control signal to said flow control valve of the user side machine.

2. An air conditioning system as recited in claim 1, wherein said control means has a function of determining the set opening ratio with considering a signal output from said physical value detecting means and a height, in which the user side machine is mounted, relative to a height in which the heat source side machine is mounted.

3. An air conditioning system as recited in claim 2, wherein said control means has a function of determining the set opening ratio of said flow control valve greater in accordance that the user side machine is mounted on an higher floor.

4. An air conditioning system as recited in claim 1, said control means has a function of holding the opening ratio of said flow control valve at a predetermined small opening ratio for a predetermined period when a cooling has been started.

5. An air conditioning system as recited in claim 4, wherein said control means has a function of holding the opening ratio of said flow control valve at a smaller opening ratio in accordance that the user side machine is mounted on the higher floor for a predetermined period when the cooling has been started.

6. An air conditioning system as recited in claim 1, a flow passage stitching mechanism and a pump are provided in a liquid phase pipe in which a liquid phase fluid flows, the fluid absorbed heat in the heat source side machine and evaporated is introduced into the user side machine so as to be discharged heat and condensed, the condensed fluid is returned to the heat source side machine by the discharging force of said pump so that a heating is performed in each of the user side machines, and said control means has a function of holding the opening ratio of said flow control valve at a predetermined large opening ratio for a predetermined period when a heating has been started.

7. An air conditioning system as recited in claim 6, wherein said control means has a function of holding the opening ratio of said flow control valve at a larger opening ratio in accordance that the user side machine is mounted on the lower floor for a predetermined period when the heating has been started.

8. An air conditioning system as recited in claim 1, wherein a flow passage switching mechanism and a pump are provided in a liquid phase pipe in which a liquid phase fluid flows, the fluid absorbed heat in the heat source side machine and evaporated is introduced into the user side machine so as to be discharged heat and condensed, the condensed fluid is returned to the heat source side machine by the discharging force of said pump so that a heating is performed in each of the user side machines, and said control means has a function of almost fully opening the opening ratio of said flow control valve at a time of detecting an insufficiency in the circulating amount of said fluid during a heating.

9. An air conditioning system as recited in claim 8, wherein a liquid phase pipe in which the liquid phase fluid flows and a gas phase pipe in which the gas phase fluid flows are respectively divided from main pipes connected to the heat source side machine, end portions of the divided pipes connected to the respective user exchangers are connected to each other via an opening and closing valve, and said control means has a function of opening the opening and closing valve in response to the fully opening operation of said flow control value in an interlocking manner.

10. An air conditioning system as recited in claim 9, wherein said control means has a function of once opening said opening and closing valve at a time of starting a heating.

11. An air conditioning system as recited in claim 1, wherein when said physical value detecting means recognizes a state that an inlet or outlet temperature of the fluid flowing in the effectively operating user side machines or a difference of the physical value effected by the temperature difference is significant in comparison with that of the plurality of the other effectively operating user side machines continues for a predetermined period of time, said control means has a function of adjusting said flow control valve of the plurality of the other user side machines in a direction of resolving said significant state of the user side machine in the significant state.

12. An air conditioning system as recited in claim 1, wherein when said physical value detecting means recognizes a state that an inlet or outlet temperature of the fluid flowing in an effectively operating user side machine or a difference of the physical value effected by the temperature difference is significant in comparison with that of the plurality of the other effectively operating user side machines continues for a predetermined time period, said control means has a function of adjusting the flow control valve of said effectively operating user side machine in a direction of resolving said significant state.

* * * * *

UNITED STATES PATENT AND TRADEMARK OFFICE

CERTIFICATE OF CORRECTION

PATENT NO. : 6,006,528
DATED : December 28, 1999
INVENTOR(S) : Hidetoshi Arima et al.

It is certified that error appears in the above-identified patent and that said Letters Patent is hereby corrected as shown below:

Column 1,
Line 4, "Intention" should read -- Invention --;

Column 3,
Line 38, "machine -" should read -- machine. --;

Column 4,
Line 1, "secured" should read -- secured. --;
Line 23, "exchangers" should read -- exchanger, --;

Column 6,
Line 48, "s" should read -- 5 --;

Column 9,
Line 18, "function -" should read -- function. --;
Line 53, "decreased" should read -- decreased. --;

Column 10,
Line 24, "I" should read -- 1 --;
Line 37, "reduced)" should read -- reduced). --;
Line 49, "change" should read -- change. --;
Line 66, "9-134a" should read -- R-134a --;

Column 11,
Line 18, "long" should read -- long. --;
Line 66, "the condensed the" should read -- the condensed --;

Column 12,
Line 5, "1" should read -- 1. --;
Line 50, "thereof" should read -- thereof. --;

UNITED STATES PATENT AND TRADEMARK OFFICE

CERTIFICATE OF CORRECTION

PATENT NO. : 6,006,528
DATED : December 28, 1999
INVENTOR(S) : Hidetoshi Arima et al.

It is certified that error appears in the above-identified patent and that said Letters Patent is hereby corrected as shown below:

Column 13,
Line 22, "1" should read -- 1. --;
Line 53, "55" should read -- S5 --;

Column 14,
Line 25, "or" should read -- of --;

Column 15,
Line 8, "8" should read -- 8. --;
Line 18, "Flow control valves 8" should read -- flow control valves 8. --;
Line 39, "judged -" should read -- judged. --;
Line 48, "taxing" should read -- taking --;

Column 16,
Line 11, "secured" should read -- secured. --;
Line 37, "judged" should read -- judged. --;
Line 50, "$\Delta T_1$" should read -- $\Delta T_i$ --;

Column 17,
Line 36, "B" should read -- 8 --;

Column 18,
Line 44, "$\Delta T_1$" should read -- $\Delta T_i$ --;
Line 45, "$\Delta T_1$" should read -- $\Delta T_i$ --;
Line 54, "B" should read -- 8 --;
Line 55, "$\Delta T_1$" should read -- $\Delta T_i$ --;

Column 19,
Line 16, "Machine" should read -- machine --;

Column 20,
Line 25, "circulating the" should read -- circulating --;
Line 61, "floor" should read -- floor. --;

UNITED STATES PATENT AND TRADEMARK OFFICE

CERTIFICATE OF CORRECTION

PATENT NO. : 6,006,528
DATED : December 28, 1999
INVENTOR(S) : Hidetoshi Arima et al.

It is certified that error appears in the above-identified patent and that said Letters Patent is hereby corrected as shown below:

Column 21,
Line 21, "In" should read -- in --;

Column 22,
Line 21, "poser" should read -- power --;

Column 22, claim 6,
Line 66, "stitching" should read -- switching --; and

Column 24, claim 9,
Line 5, "value" should read -- valve --.

Signed and Sealed this

Second Day of April, 2002

*Attest:*

*Attesting Officer*

JAMES E. ROGAN
*Director of the United States Patent and Trademark Office*